US006924714B2

(12) United States Patent
Jain

(10) Patent No.: US 6,924,714 B2
(45) Date of Patent: Aug. 2, 2005

(54) HIGH POWER TERMINATION FOR RADIO FREQUENCY (RF) CIRCUITS

(75) Inventor: Nitin Jain, San Diego, CA (US)

(73) Assignee: Anokiwave, Inc., San Diego, CA (US)

( * ) Notice: Subject to any disclaimer, the term of this patent is extended or adjusted under 35 U.S.C. 154(b) by 0 days.

(21) Appl. No.: 10/438,723

(22) Filed: May 14, 2003

(65) Prior Publication Data

US 2004/0227582 A1 Nov. 18, 2004

(51) Int. Cl.[7] ..... H01P 5/12
(52) U.S. Cl. ..... 333/123; 333/33
(58) Field of Search ..... 333/12, 17.3, 22 R, 333/33, 213

(56) References Cited

U.S. PATENT DOCUMENTS 3,678,417 A * 7/1972 Ragan et al. ..... 333/22 R
4,626,805 A * 12/1986 Jones ..... 333/33
5,693,595 A * 12/1997 Talisa et al. ..... 505/210
5,831,491 A * 11/1998 Buer et al. ..... 333/128
6,016,085 A * 1/2000 Mazzochette ..... 333/22 R
6,087,907 A 7/2000 Jain
6,104,258 A * 8/2000 Novak ..... 333/22 R
6,326,862 B1 * 12/2001 Ferguson et al. ..... 333/22 R
6,353,540 B1 * 3/2002 Akiba et al. ..... 361/794

OTHER PUBLICATIONS

Thomas P. Budka, "Wide–Bandwidth Millimeter–Wave Bond–Wire Interconnects"; IEEE Transactions on Microwave Theory and Techniques, vol. 49, No. 4, pp. 715–718, Apr. 2001.

* cited by examiner

*Primary Examiner*—Michael Tokar
*Assistant Examiner*—Linh V. Nguyen
(74) *Attorney, Agent, or Firm*—Fish & Richardson P.C.

(57) ABSTRACT

In an embodiment, a termination for a transmission line (or high frequency circuit) includes a matching circuit which provides a matching impedance for the transmission line and an electrical connection between the two, e.g., a bond wire. The electrical connection has a reactance matrix, which, when combined with the impedance provided by the matching circuit, provides a resultant termination resistance.

17 Claims, 18 Drawing Sheets

2-42 GHz Sweep (Length 800 μm)

2-42 GHz Sweep (Length 800 μm Ind = 0.3nH Zo = 150)

HIGH POWER TERMINATION FOR RADIO FREQUENCY (RF) CIRCUITS

BACKGROUND

This invention relates generally to microwave and millimeter wave (mm-wave) radio frequency (RF) circuits, and more particularly to terminations for transmission line and one-sided matching to include wire bond inductances.

It is well known that an impedance change can cause signal reflection in high speed circuits. The reflection coefficient is given by:

$$\Gamma = \frac{Z_L - Z_o}{Z_L + Z_o} \quad \text{(eq. 1)}$$

where $Z_L$ is the load impedance and $Z_o$ is the transmission line characteristic impedance. When transmission lines end in an open circuit, $Z_L$ is infinity. As a result $\Gamma$ is one and the signal is entirely reflected back. It is therefore important to provide a match termination to reduce reflection and signal bounce in many high speed circuits such as hybrid couplers, T/R modules, circulators, power combiners, absorptive filters, doublers, mixers couplers and so on. In addition, a typical high frequency switch-matrix used for optical signal routing has N by N lines crossing each other and going to the edge of the chip. Each of the line ends need termination. Thus a total of $N^2$ terminations are required. Since the switch-matrixes are made on an expensive substrate such as Indium Phosphide (InP) or Gallium Arsenide (GaAs) to allow high frequency signal processing, it may be desirable to terminate these transmission lines in their characteristic impedance outside the integrate circuit (IC). Often the terminations need to absorb 1–5 W of power and have broadband width (e.g., DC-to-40 GHz).

Since high power terminations require large chip area and are built on thermally conductive substrates such as Aluminum Nitride (AlN) and Beryllium Oxide (BeO), they are often included outside the expensive InP or GaAs chip. Moreover, a single bond-wire is often desirable as it is compatible for large-scale manufacturing. The bond wire is electrically represented by an equivalent circuit that usually comprises of a reactance matrix comprising of shunt capacitance followed by a series inductance and another shunt capacitance. The reactance matrix is dominated by the series inductance.

SUMMARY

In an embodiment, a termination for a transmission line (or high frequency circuit) includes a matching circuit which provides a matching impedance for the transmission line and an electrical connection between the two, e.g., a bond wire. The electrical connection has a reactance matrix, which, when combined with the impedance provided by the matching circuit, provides a resultant termination resistance.

The matching circuit may include grounding means, passive elements, and a thin film resistor (which may be monolithic or multi-sectioned). The dimensions and geometry of the thin film resistor may be selected to provide a negative inductance which matches the bond wire inductance.

The termination is on a different substrate than the transmission line. The material used for the termination substrate may be less expensive than that used for the transmission line. Substantially all matching is provided on the termination.

The termination may provide high power handling (>1 W) and a high frequency bandwidth (e.g., DC-to-40 GHz).

DETAILED DESCRIPTION

Figure 1:
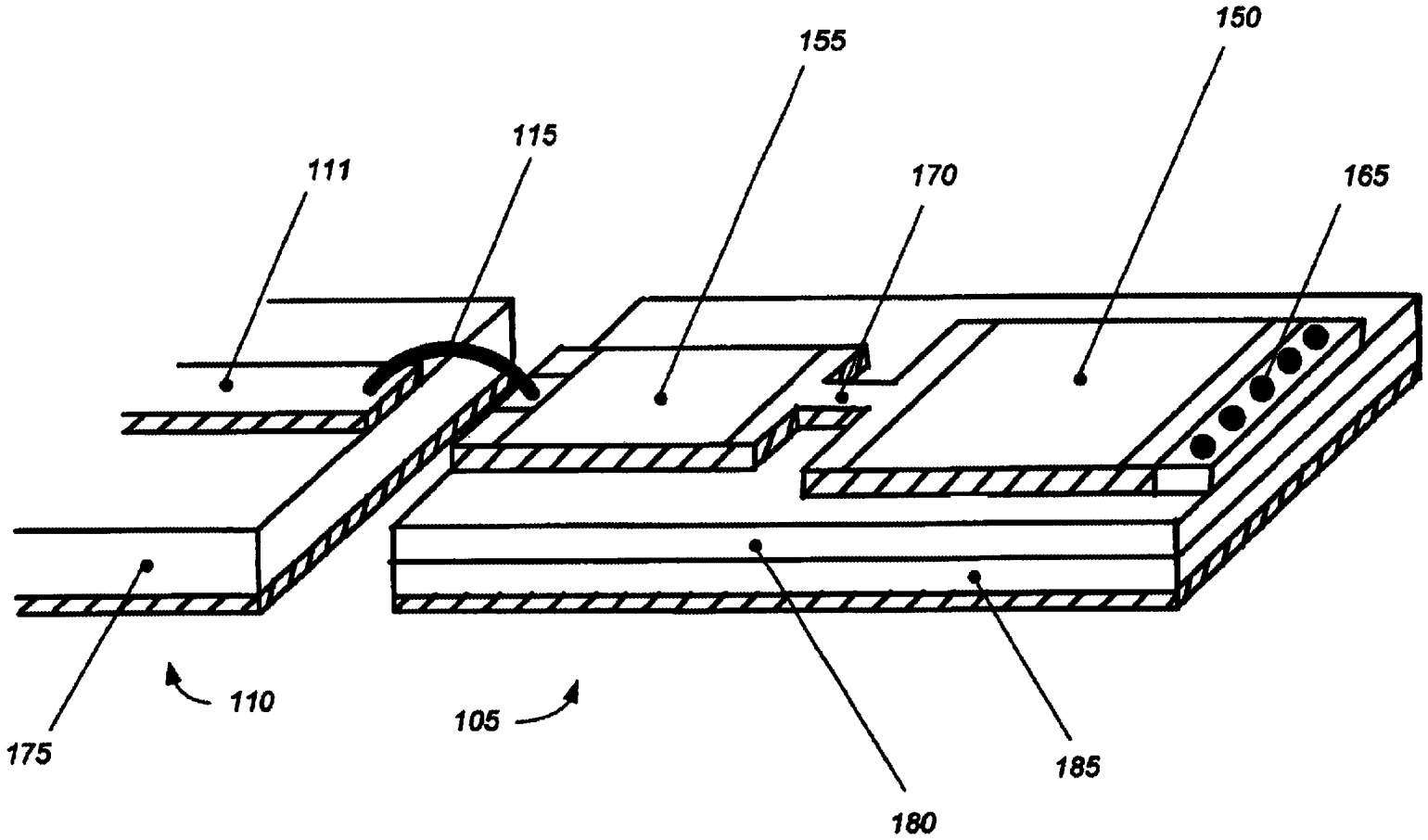
FIG. 1 is a perspective view of a transmission line connected to a termination by a bond wire.

FIG. 1 shows a load termination 105 connected to a transmission line 110 by a bond wire 115. The termination includes a thin film resistor that provides impedance matching for the transmission line. The thin film resistor may compensate for the inductance of the bond wire by creating an impedance that looks like a negative inductance. The thin film resistor may enable the termination to provide high power handling (>1 W) and high frequency bandwidth (e.g., DC-to-40 GHz).

The thin film resistor may be provided on a planar substrate, e.g., a glass chip. The dimensions and configuration of the thin film resistor(s) may be selected to produce a negative inductance that substantially matches the inductance of the bond wire, thereby compensating for the bond wire inductance. All matching components may be provided on the chip resistor.

At a single frequency, a negative inductor may be indistinguishable from a capacitor. However, the impedance of the negative inductor increases with increasing frequency. The following analysis derives an approximate equation confirming the existence of negative inductance. For lossy circuit line we have:

$$Z_{in} = Z_o \tan h(\gamma d) \text{ (For lossy short circuit line)} \quad \text{(eq. 2)}$$

Where $$Z_o = \sqrt{\frac{R + j\omega L}{j\omega C}} \quad \text{(eq. 3)}$$

and $$\gamma = \sqrt{(R + j\omega L) j\omega C} \quad \text{(eq. 4)}$$

If □d is much smaller than 1 then since:

$$\tanh(x) = 1 - \frac{x^3}{3} + \ldots \quad \text{(eq. 5)}$$

it follows that:

$$Z_{in} = Z_o\left(\gamma d - \frac{\gamma d^3}{3} + \ldots\right) \quad \text{(eq. 6a)}$$

or $$\approx \sqrt{\frac{R + j\omega L}{j\omega C}}\left(\left(\sqrt{(R + j\omega L) j\omega C}\right)d - \frac{\left(\sqrt{(R + j\omega L) j\omega C}\right)^3 d^3}{3}\right) \quad \text{(eq. 6b)}$$

$$\approx Rd + j\omega Ld - j\omega C\frac{R^2 d^3}{3} + 2R\frac{\omega^2 LCd^3}{3} + j\omega^3\frac{L^2 Cd^3}{3} \quad \text{(eq. 6c)}$$

For the imaginary part to be negative we require:

$$j\omega C\frac{R^2 d^3}{3} > j\omega Ld + j\omega^3\frac{L^2 Cd^3}{3} \quad \text{(eq. 7)}$$

or $$\frac{C}{L}\frac{R^2 d^2}{3} > 1 + \omega^2\frac{LCd^2}{3} \quad \text{(eq. 8)}$$

If the length of the resistor is small then the second term on right is small, and $$\sqrt{\frac{C}{3L}}\,Rd > 1 \quad \text{(eq. 9a)}$$

or $$Rd > \sqrt{\frac{3L}{C}} \quad \text{(eq. 9b)}$$

A description of the equation analysis begins with the input impedance of eq. 2. The impedance $Z_{in}$ depends on the characteristic impedance of the transmission line $Z_o$ from eq. 3 and the propagation constant γ from eq. 4. Zo and γ are integrated in eq. 2, by using hyperbolic tangent approximation of eq. 5. The result is shown in eq. 6 going through steps from 6a to 6c. Eq. 7 sets a condition for which the imaginary part of eq. 6c becomes negative. Becoming negative, it creates a negative inductance. Condition from eq. 7 is simplified in eq. 8. Considering the small length of the resistor, eq. 9a evolved from eq. 8. The resistance and its length are related to the inductance and capacitance of the thin film resistor by eq. 9b.

Figure 2:
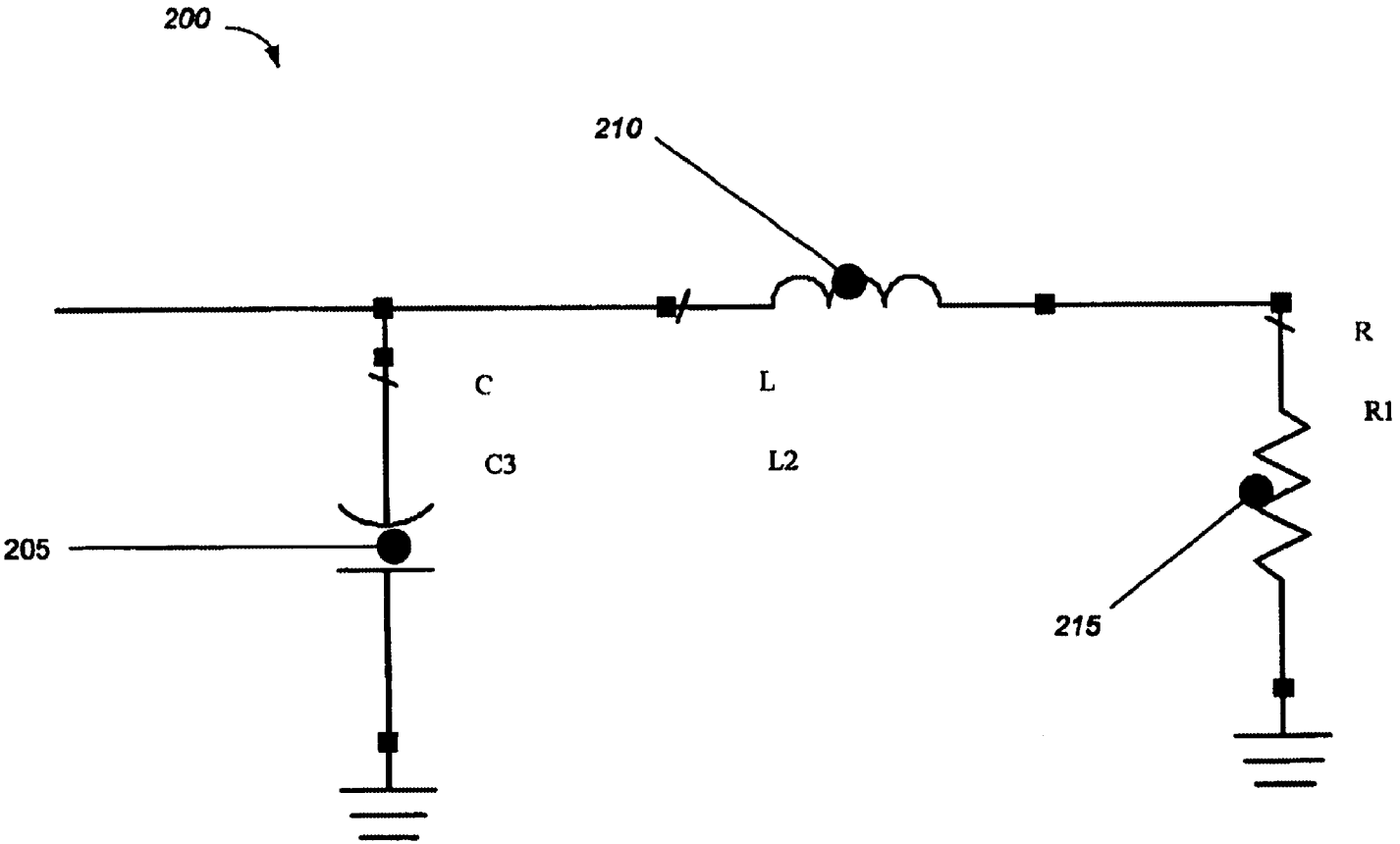
FIG. 2 is a schematic representation of a negative impedance lumped element circuit.

FIG. 2 shows a schematic representing a negative impedance lumped element circuit 200. This figure consists of three elements. Capacitance to ground 205 is related to the width and length of the thin film resistor and to the substrate thickness of the termination. The inductance 210 is the negative inductance. The resistance 215 is the real part of the impedance of the thin film resistor.

Figure 3:
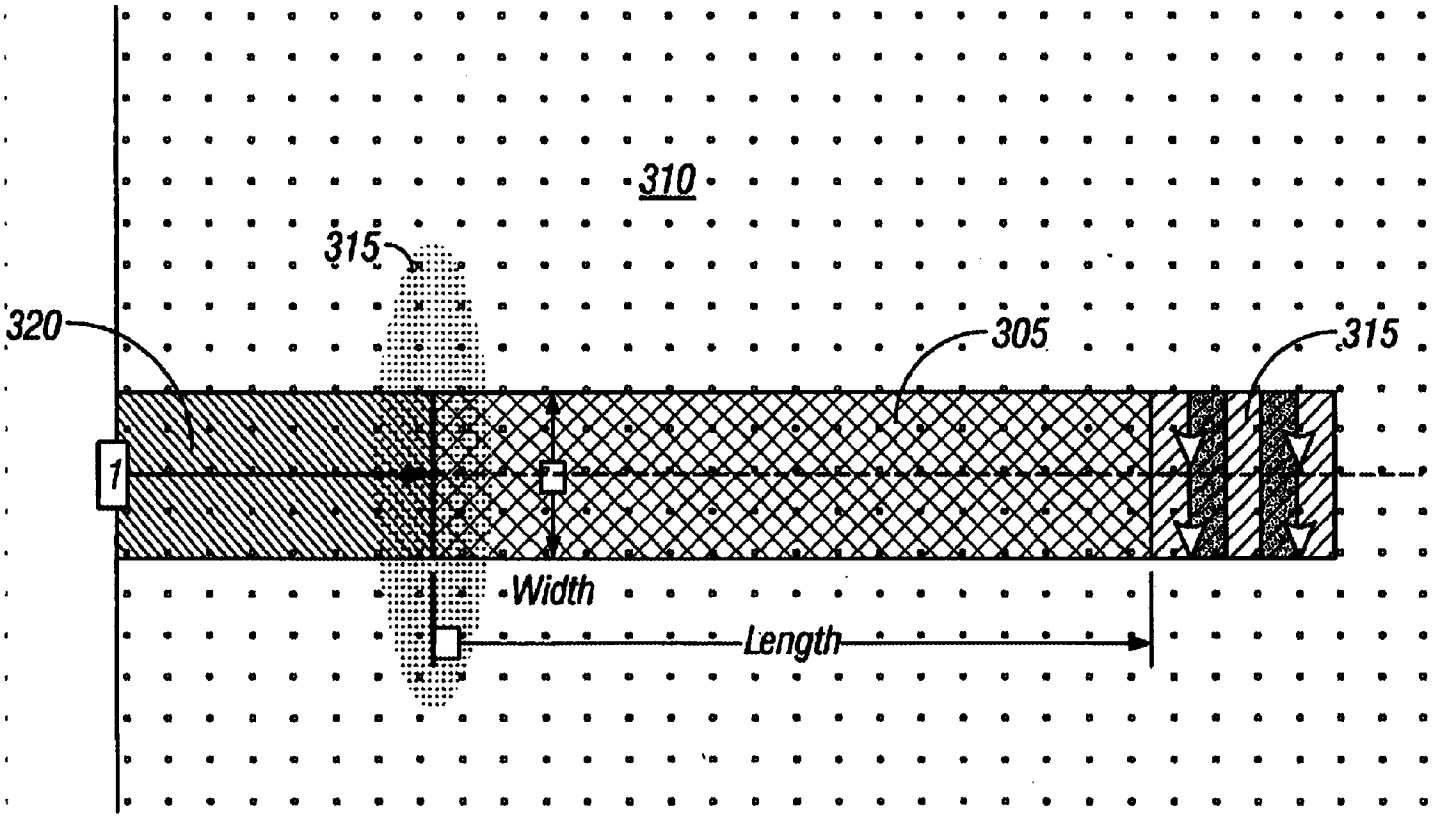
FIG. 3 is a plan view of a termination according to an embodiment.
Figure 4:
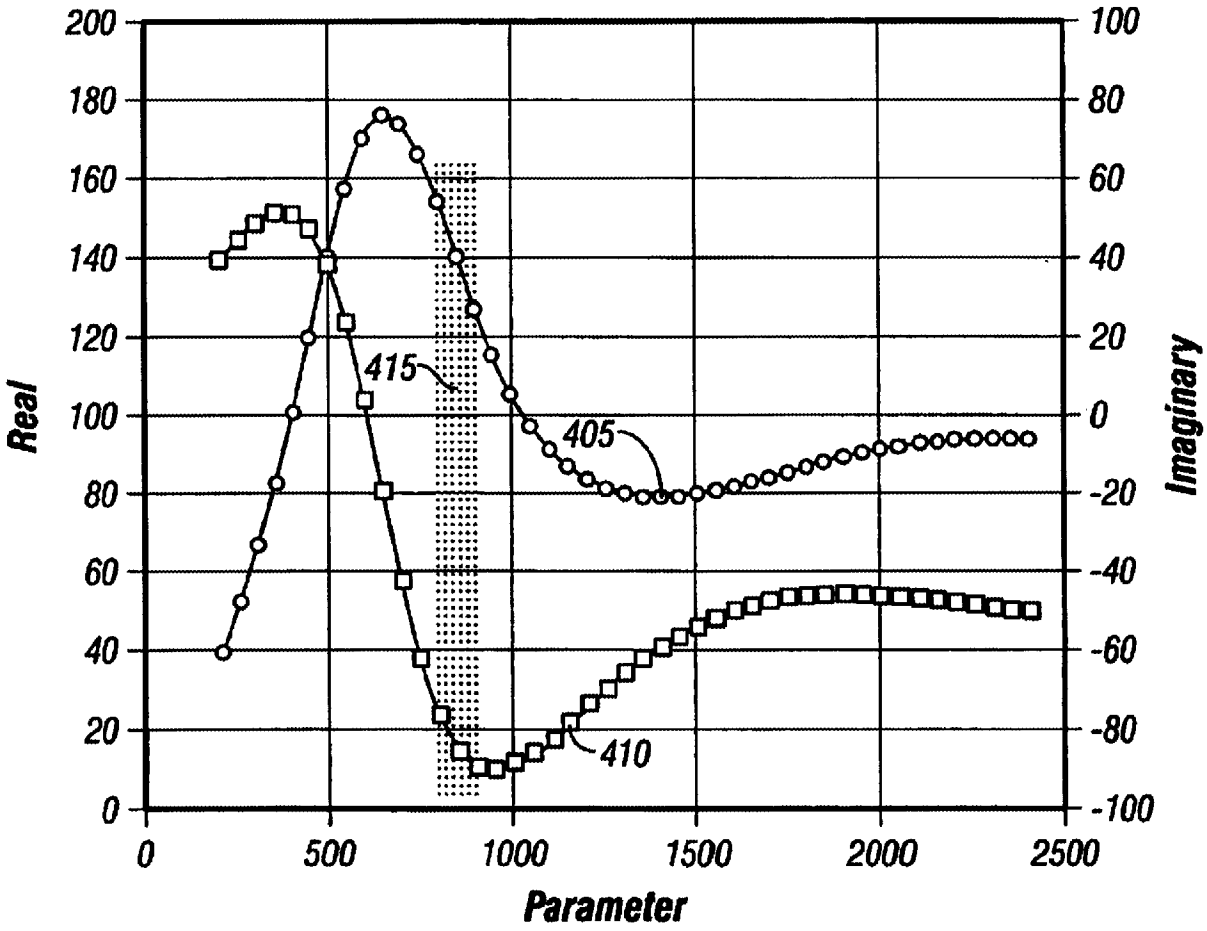
FIG. 4 is a graph showing impedance versus length for a thin film resistor in the termination.
Figure 5:
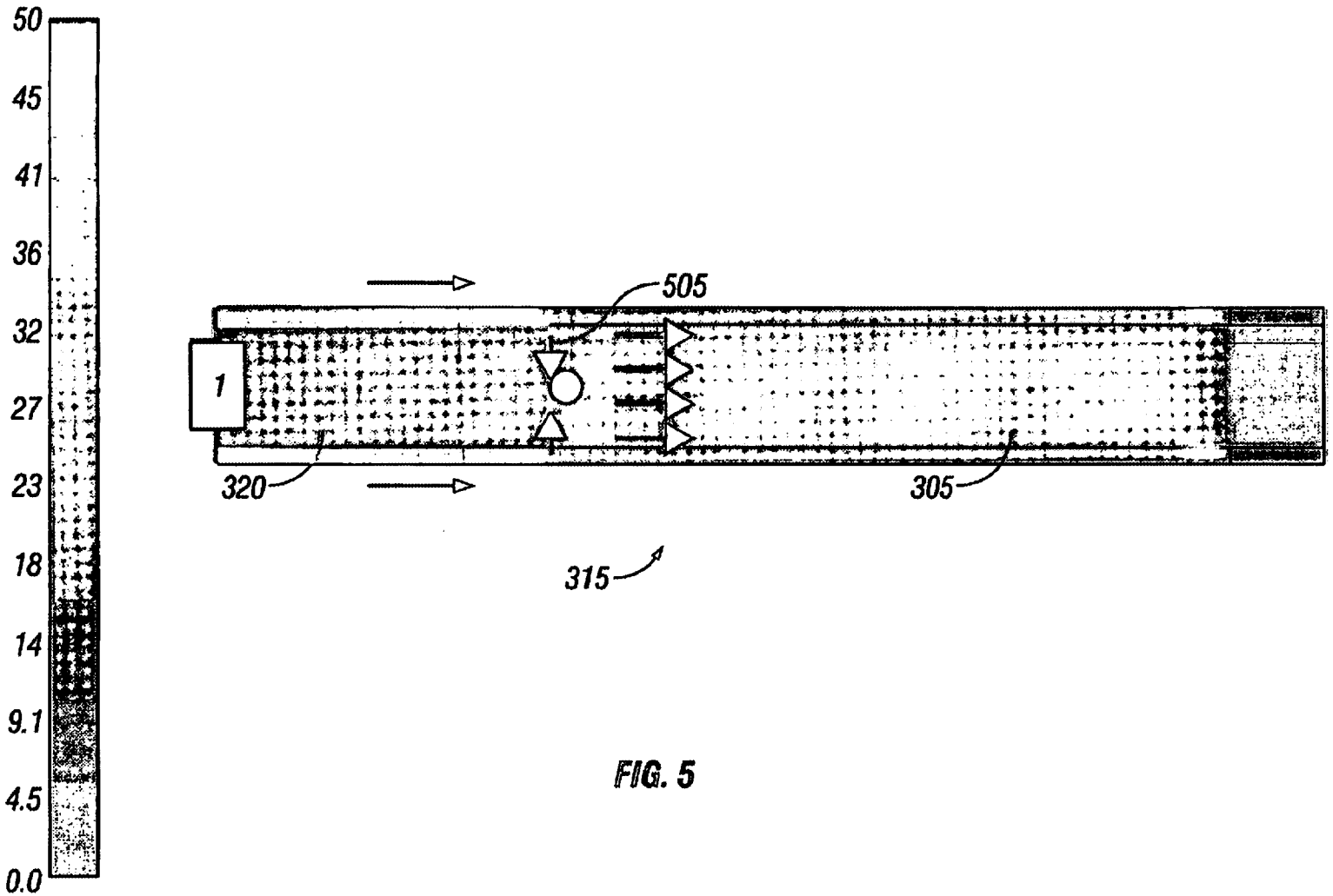
FIG. 5 is a schematic representation of current flow in the resistor.

FIG. 3 shows a termination according to an implementation. The termination includes a 200 μm wide thin film resistor 305 on an 8 mil glass substrate 310. By varying the length and width of the thin film resistor 305, the negative inductance may be balanced to that of the bond wire 115. FIG. 4 is a graph showing impedance versus length for the thin film resistor. Resistance 405 and reactance 410 are plotted at 40 GHz. The resistance length of 800 μm at the minimum reactance 415 value produces 150 Ohms of resistance. The reactance includes a transmission line to resistor film discontinuity due to current redistribution, referred to as contact inductance. The transition 315 between transmission line 320 and the thin film resistor 305 is presented in FIG. 5. Current flows on the transmission line edges, as expected. The same current flows uniformly throughout the film resistor. In the transition region the current density is distributed in the manner of uniform tendency 505.

Figure 6:
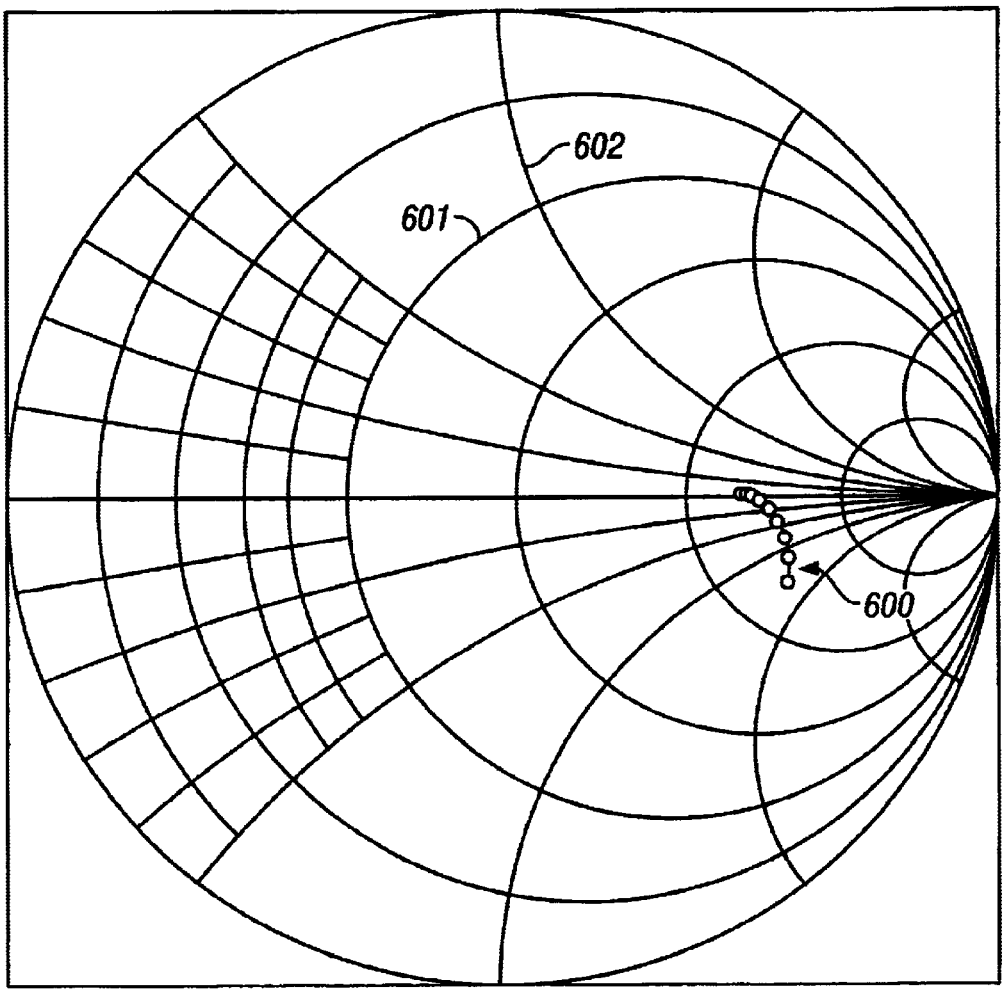
FIG. 6 is a Smith chart showing the negative inductance produced by an 800 $\mu$m long termination over a frequency sweep of 2–42 GHz frequency sweep.
Figure 7:
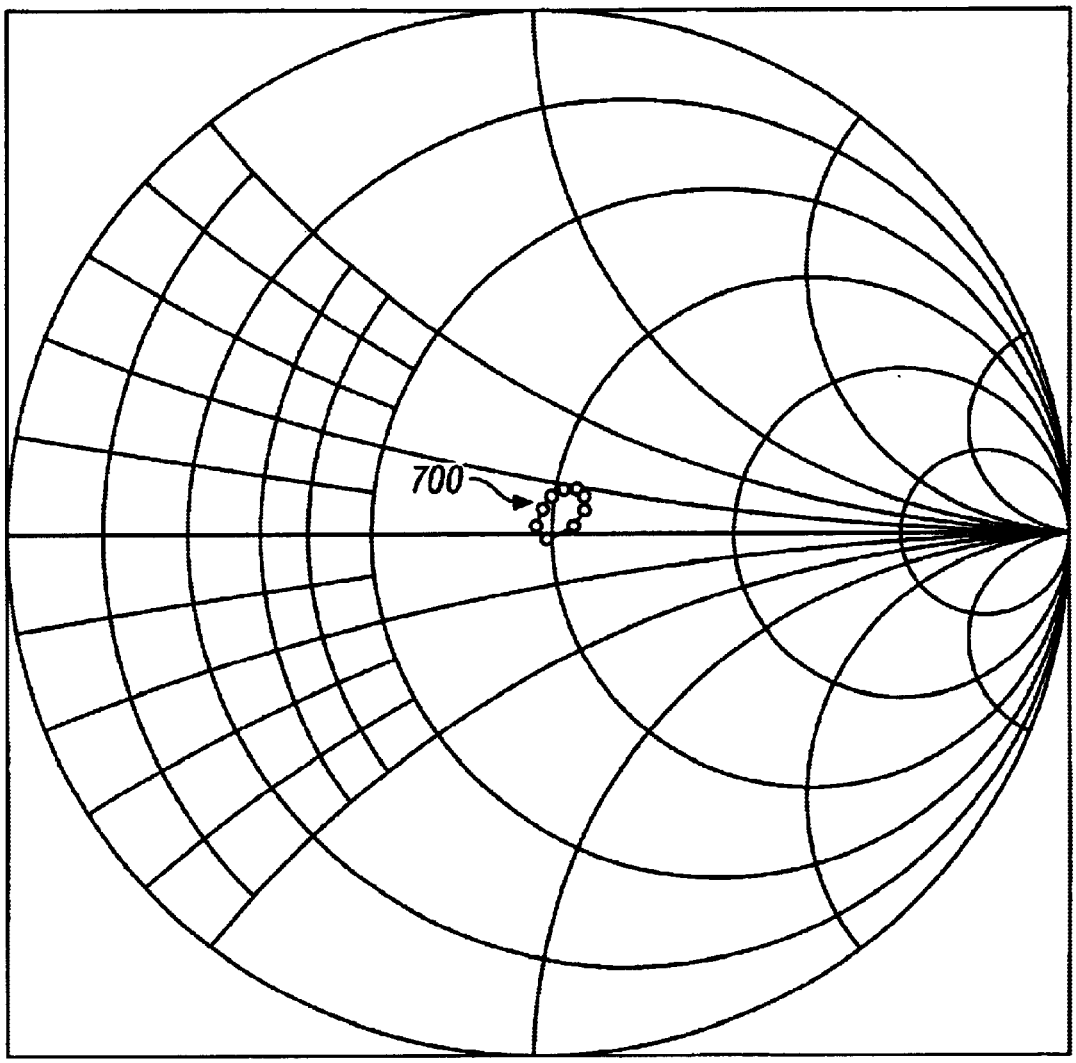
FIG. 7 is a Smith chart showing the match of the bond-wire and the termination.

Discontinuity of the transition is related to additional inductance. This inductance may be suppressed by a matching technique according to an implementation. FIG. 6 is a Smith chart showing the negative inductance produced by an 800 μm long termination over a frequency sweep of 2–42 GHz frequency sweep 600. A Smith chart is a graphical plot of normalized resistance and reactance functions in the reflection-coefficient plane, which may be used for impedance matching. The chart is a chart of r-circles 601 and x-circles 602 in the $\Gamma_r$-$\Gamma_i$ plane for $|\Gamma| \leqq 1$. The intersection of an r-circle and an x-circle defines a point that represents a normalized load impedance $Z_L$=r+jx. FIG. 7 is a Smith chart showing the match 700 of the bond-wire and the termination. The bond wire has 0.3 nH of a maximum allowable inductance and is connected to a 150 Ohm impedance.

Figure 8:
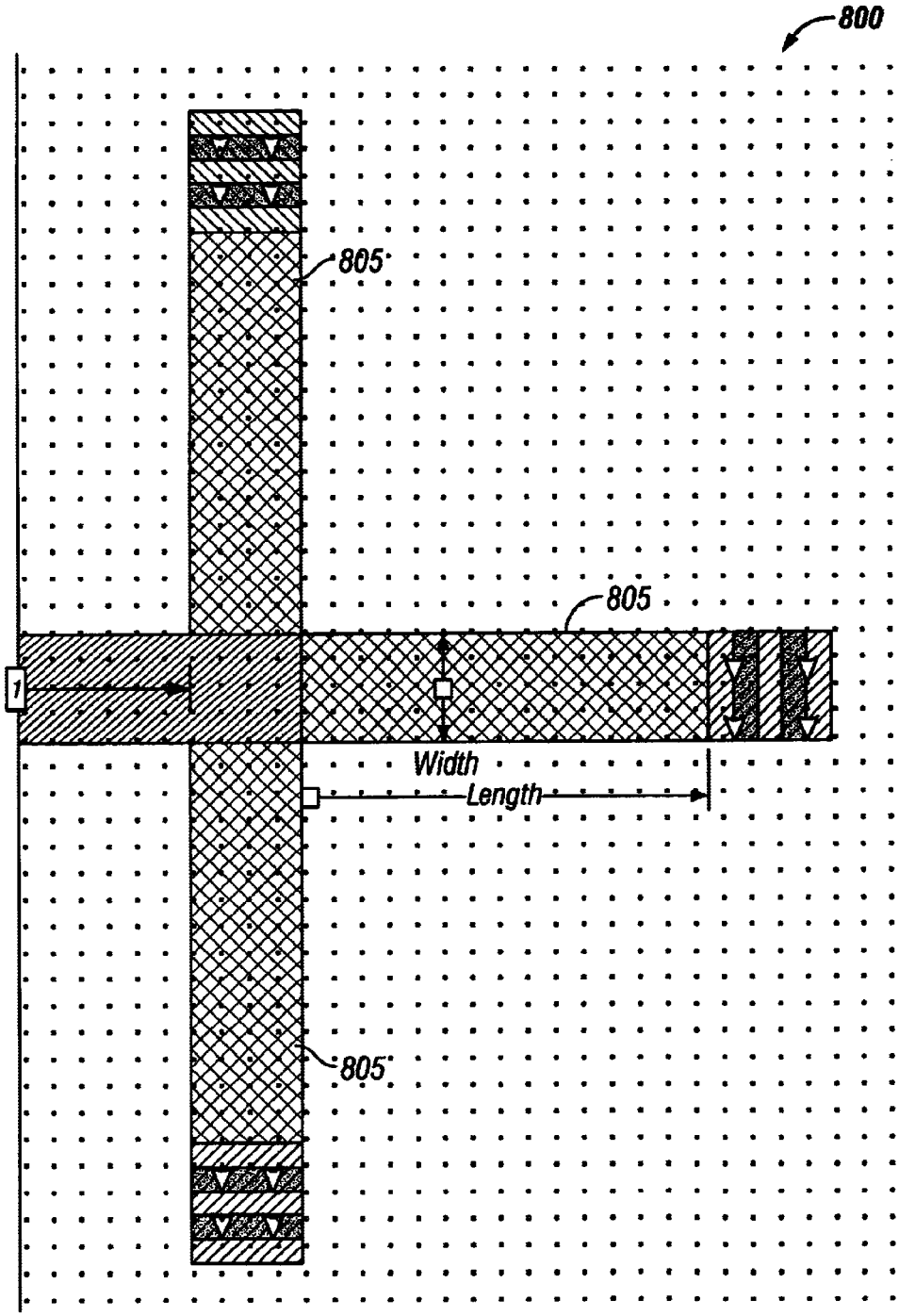
FIG. 8 is a plan view of a termination according to an embodiment.
Figure 9:
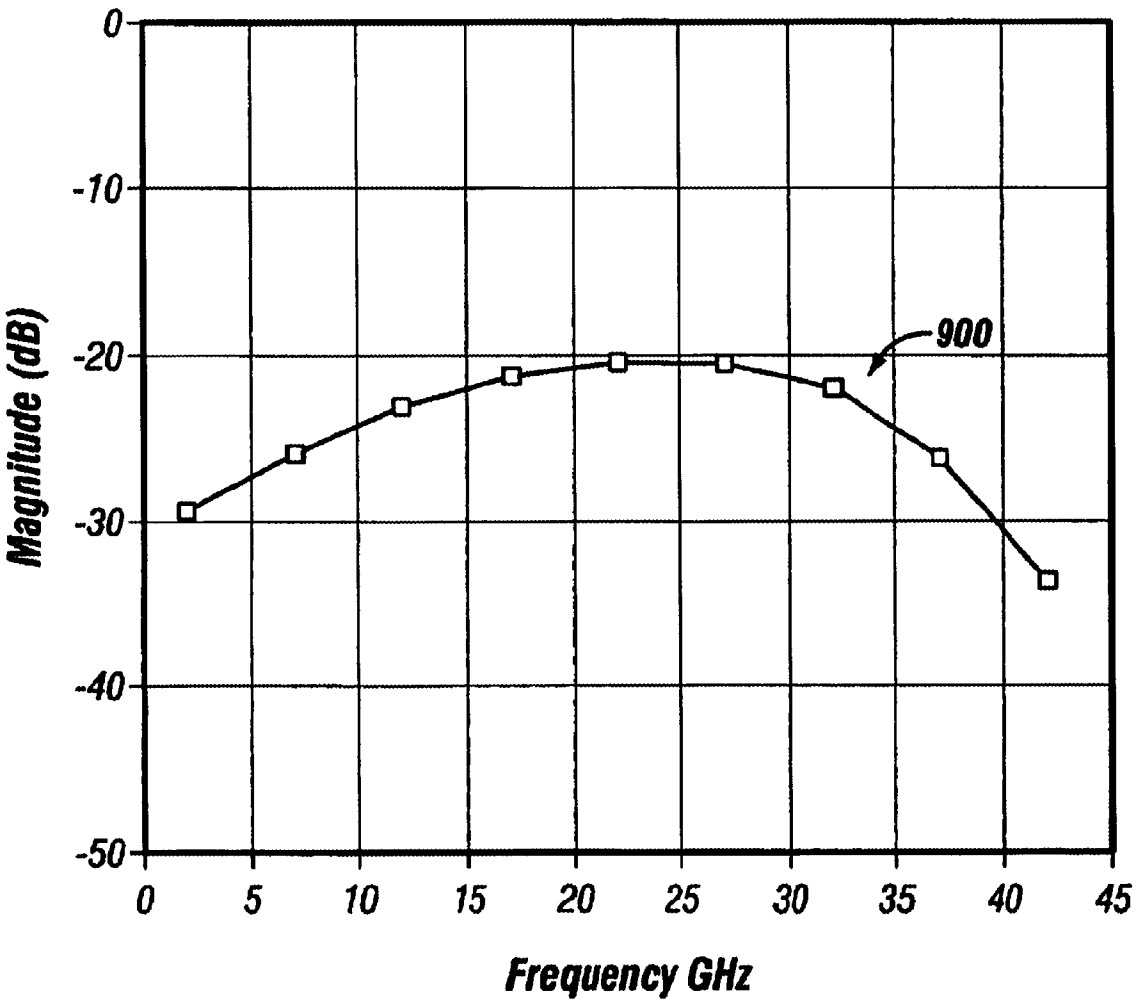
FIG. 9 is a graph showing return loss for the termination.

FIG. 8 shows an exemplary termination 800 according to an alternative implementation. The termination includes a parallel combination of 200 μm wide thin film resistors 805. Three 150 Ohm resistors 300 in parallel may be used to match a 0.07 nH maximum allowable inductance. The return loss 900 for this termination is shown in FIG. 9. The width of the terminating resistor may be expanded to 400 μm on the 8 mil glass substrate to produce an impedance of 100 Ohms. In this case, a thin resistor termination length of 950 μm may be used to match a bond wire inductance of 0.23 nH.

Figure 10:
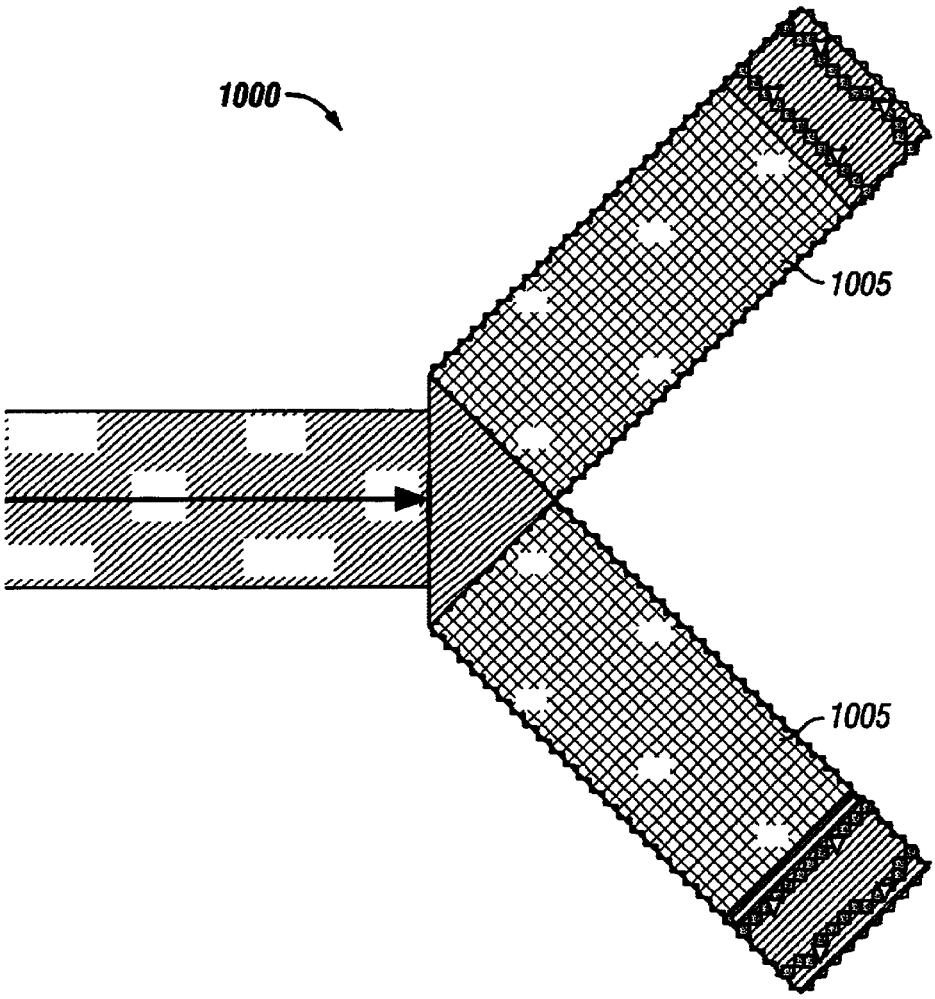
FIG. 10 is a plan view of a termination according to an embodiment.
Figure 11:
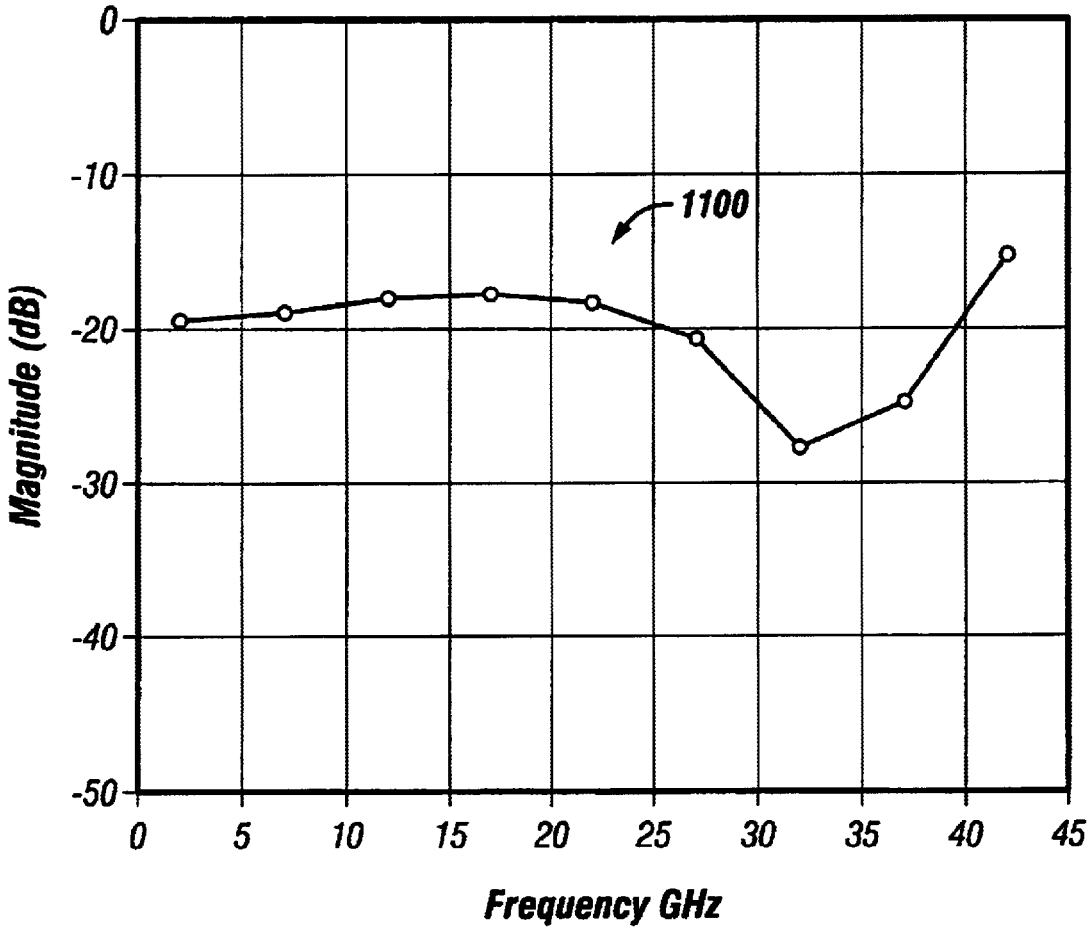
FIG. 11 is a graph showing return loss for the termination.

FIG. 10 shows a termination 1000 including two 100 Ohm thin film resistors 1005 in parallel. This parallel combination of 400 μm long resistor film terminations may be laid on an 8 mil glass substrate. This termination may be used to cancel a 0.1 nH bond wire inductance. The return loss 1100 for the termination shown in FIG. 10 is shown on FIG. 11.

The width of the termination may be expanded to 800 μm. The impedance of the thin film resistor is 50 Ohms when the termination length is 1050 μm. This length of thin film resistor may be used to match a maximum allowable bond wire inductance of 0.15 nH.

The return loss may become worse when the width of the termination resistor is expanded. However, the lower impedance values and higher resistor widths directly correspond to power handling levels. The tradeoff may be considered when designing a termination for a transmission line. Depending on the application, an 'on termination matching' technique may be used for 50, 75 and 150 Ohm transmission line terminations.

Clarification of the concept of negative inductance provided means to consider structures in which a bondwire is used to connect the transmission line to a multi-section thin film resistor. In the case of a short bond wire, the termination may be connected to the transmission line and matching on the line may be used to account for the transition. Methods of short and open stubs may be applied for matching purposes. Long bond wire termination across the gap may also be used.

Figure 12:
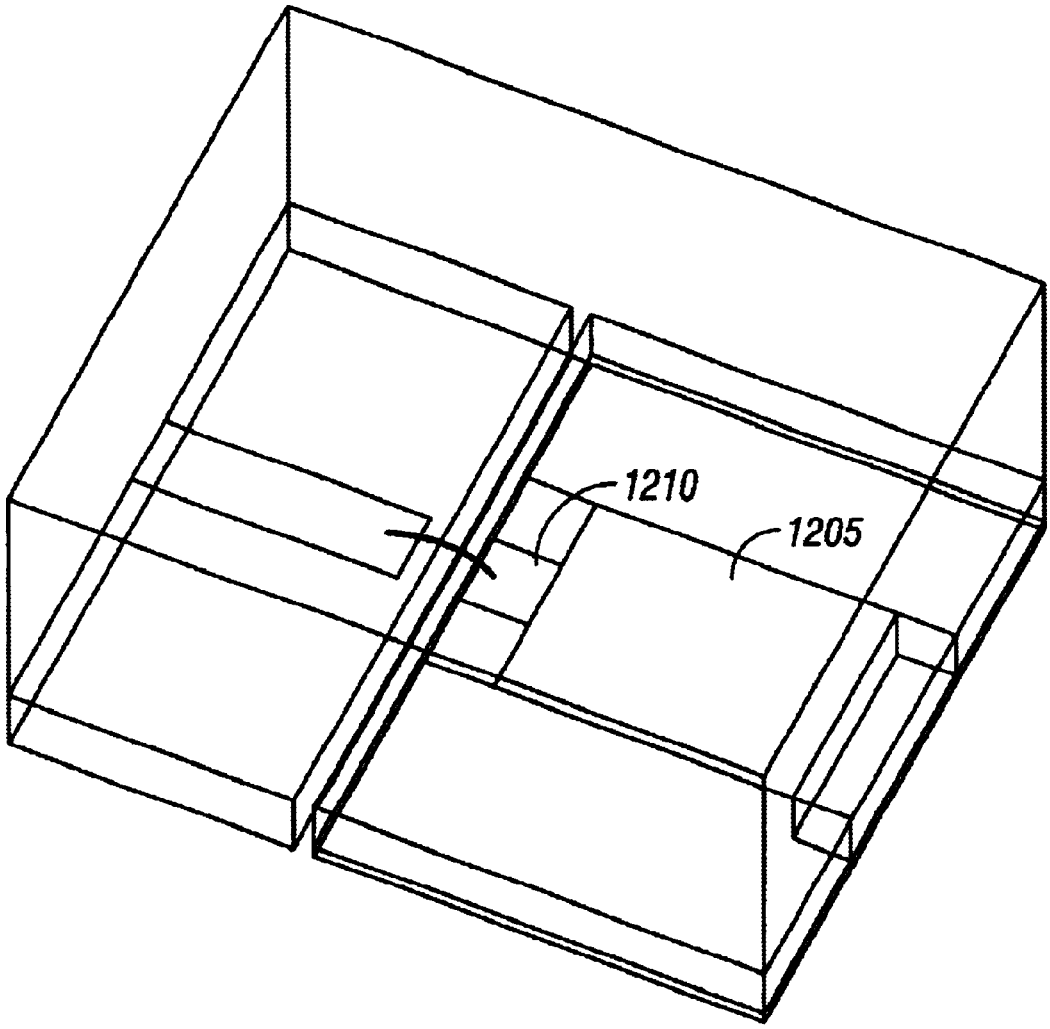
FIG. 12 is a perspective view of a transmission line connected to a termination by a bond wire.
Figure 13:
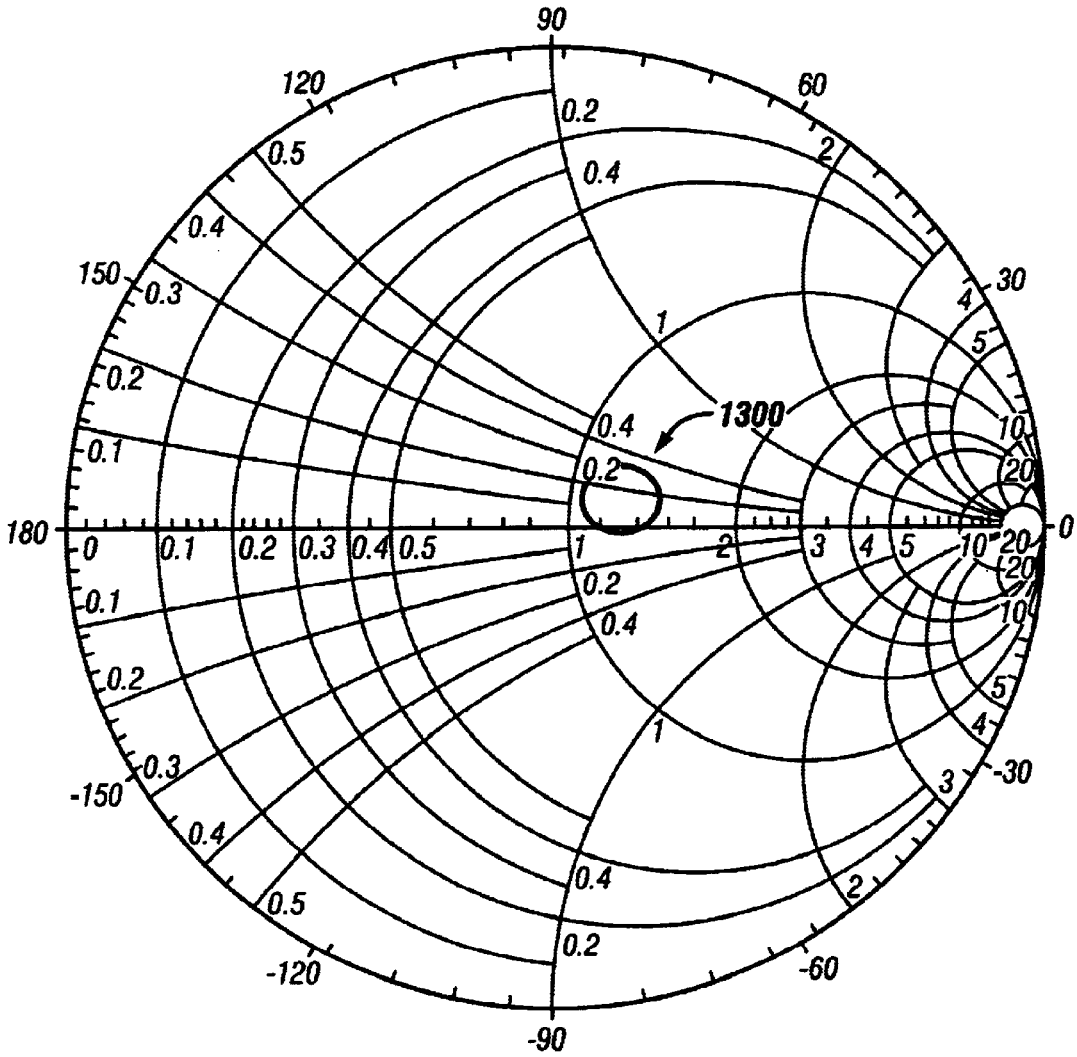
FIG. 13 is a Smith chart showing the match of the bond-wire and the termination.
Figure 14:
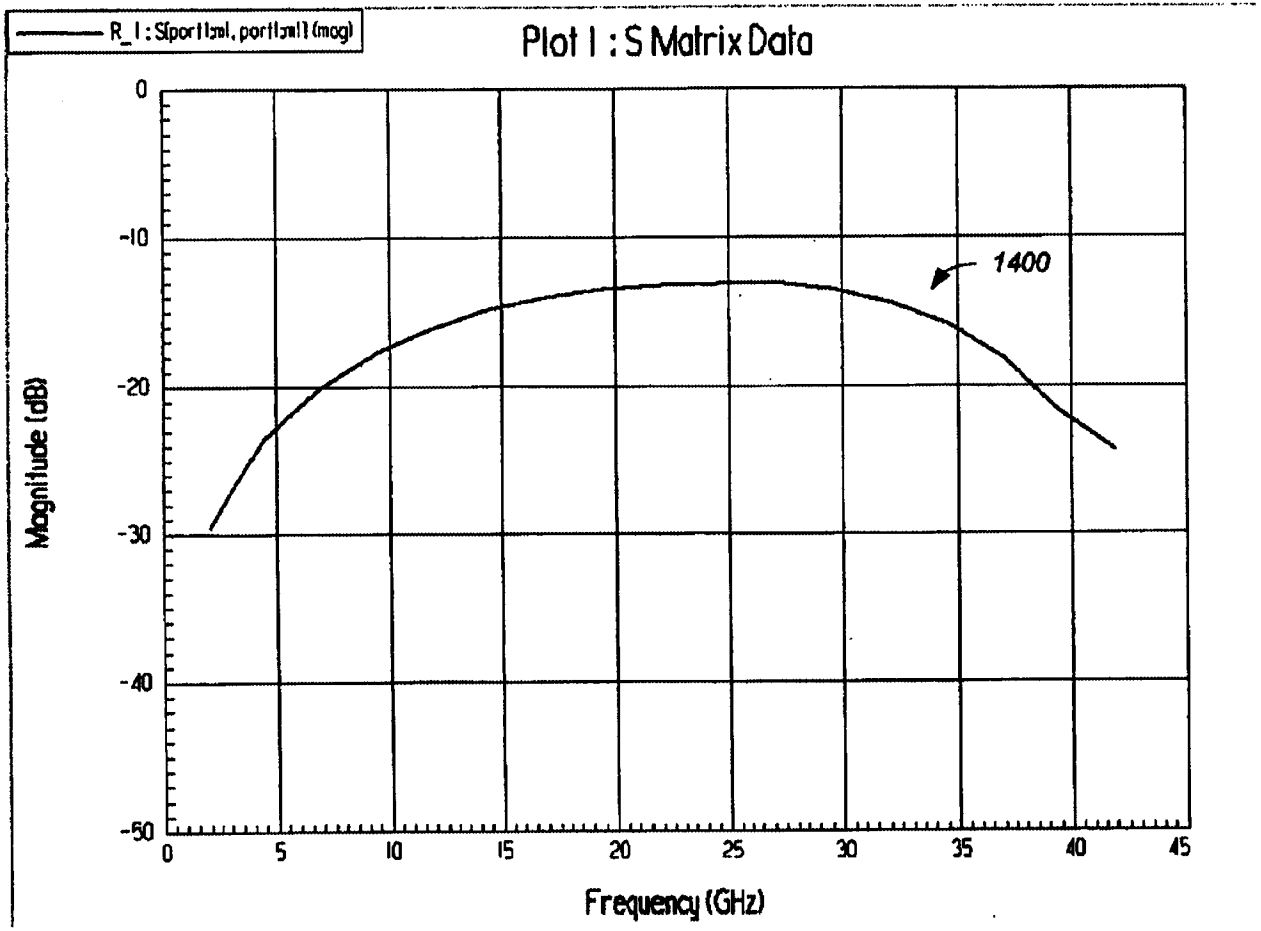
FIG. 14 is a graph showing return loss for the termination.

A single-section thin film resistor 1205 with pad 1210, such as that shown in FIG. 12, may be used to reduce contact inductance and further improve the matching. The matching 1300 of the bond wire inductance is shown on the Smith chart of FIG. 13 and its respective return loss 1400 in FIG. 14.

Referring to FIG. 1, a multi-section matching structure according to an implementation includes a two-section thin film resistor termination 150 and 155. The termination is laid on 125 mm thin film glass substrate 180. Via holes 165 connect the first impedance section 150 to ground from the one side. A strip transition impedance 170 connects the two impedance sections. The second impedance section 155 is connected with the bond wire 115 to the external transmission line 111.

Figure 15A:
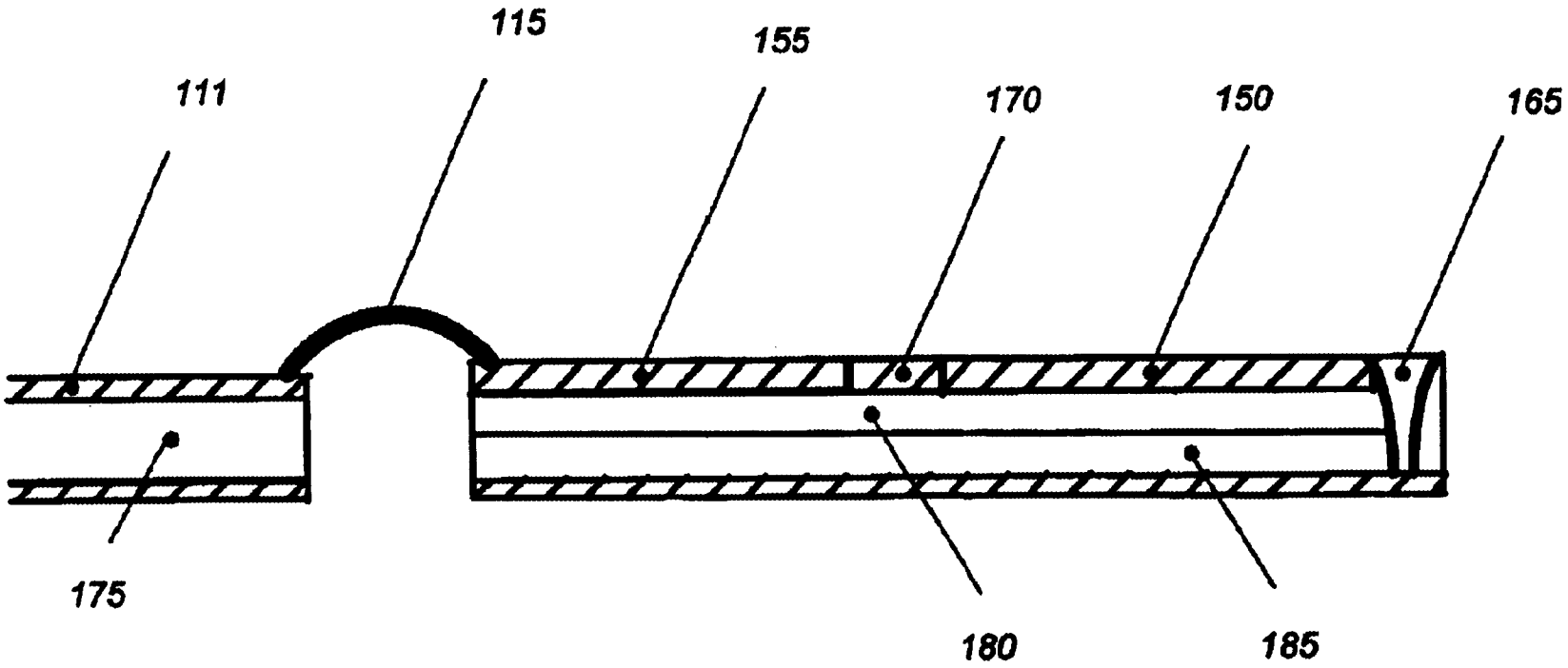
FIGS. 15A–15C are sectional views of the termination of FIG. 1.
Figure 15C:
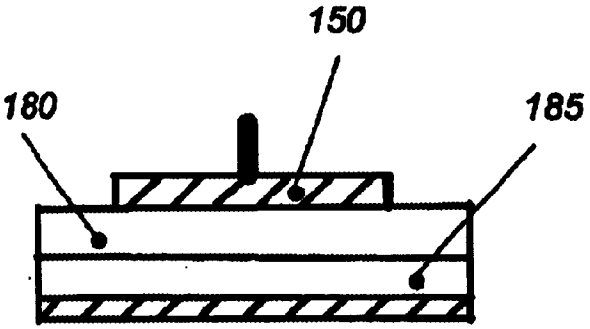
Figure 15B:
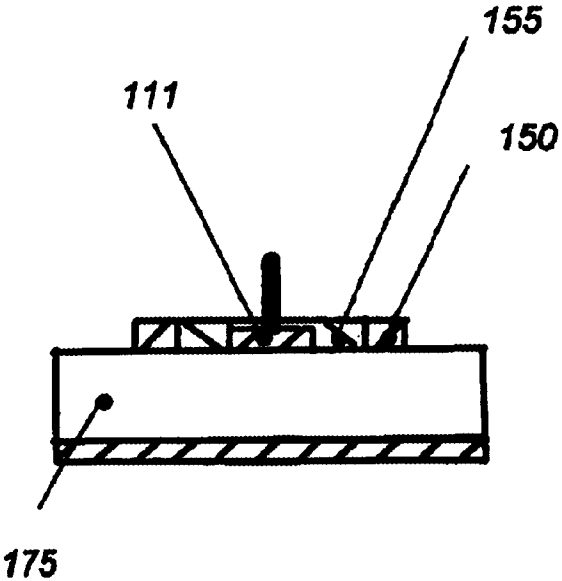

The resistance of the thin film resistance is 35-Ohm-per square and expected power handling greater then 1–2 Watts. A cross sectional view of the structure from FIG. 1 is shown in FIG. 15A, and the left and right cross sectional views are shown in FIGS. 15B and 15C. As shown in FIG. 1, the bond wire 115 connects the transmission line on an Indium Phosphate substrate 175 and the termination on the glass substrate 180. Silicon 185 may be used on the back of the glass substrate 180.

Figure 16:
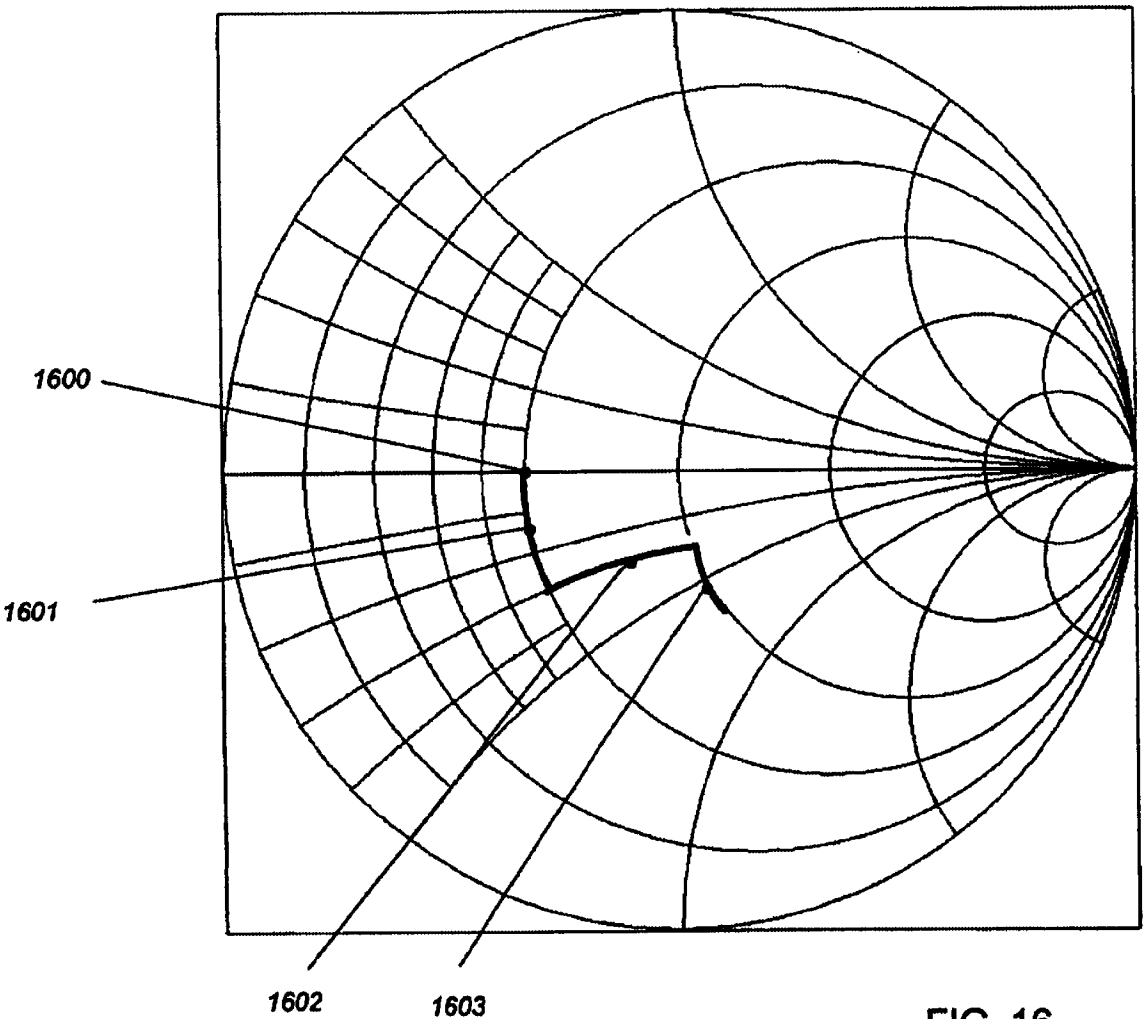
FIG. 16 Smith Chart representation of the two-section thin film resistor matching network.

The Smith Chart representation of the two-section thin film resistor matching network is shown in FIG. 16. The length of the first impedance section 150 is adjusted to about 25 Ohms (1600). Certain negative inductance 1601 is observed due to the length as well as width of the thin film resistor and thickness of the substrate 180. The second impedance section 155 is set to about 25 Ohms to give a total of 50 Ohms (1602) by adjusting its parameters. Negative inductance 1603 due to the second impedance section is added. The total negative inductance, due to each section, has the same value as bond wire inductance, and the two inductances cancel as a result of matching. Note that the term "negative inductance" is used instead of "capacitive reactance" in reference to canceling the bond wire inductance.

Figure 17:
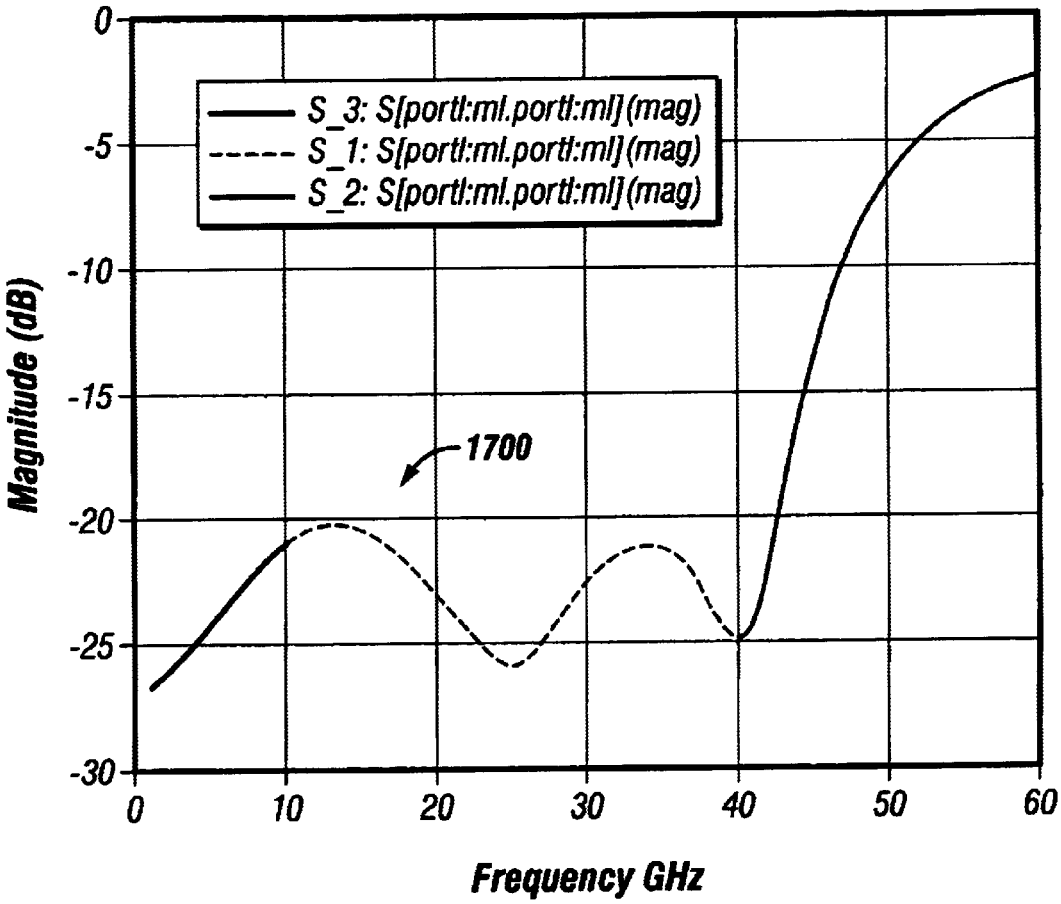
FIG. 17 is a graph showing return loss for the termination.

By using negative inductance high port isolation is achieved. As shown in FIG. 17, the return loss of this structure is less than 20 dB in up to 40 GHz frequency range.

A number of embodiments have been described. Nevertheless, it will be understood that various modifications may be made without departing from the spirit and scope of the invention. Accordingly, other embodiments are within the scope of the following claims.

What is claimed is:

1. An apparatus for terminating a transmission line, the apparatus comprising:

a substrate separate from the transmission line; and a matching circuit operative to provide a matching impedance for the transmission line and an electrical connection between the transmission line and the apparatus, the matching circuit including a resistor having dimensions and a geometry selected to generate a negative inductance having a magnitude substantially equal to an inductance of the electrical connection.

2. The apparatus of claim 1, wherein the resistor comprises a thin film resistor.

3. The apparatus of claim 1, wherein the resistor comprises a multi-section resistor.

4. The apparatus of claim 1, wherein the matching circuit further comprises:

means for providing a ground potential;

one or more passive elements; and an electrical connection between the resistor, grounding means, and passive elements to form a network having a network impedance.

5. The apparatus of claim 4, wherein the grounding means comprise via holes.

6. The apparatus of claim 4, wherein when connected between the transmission line and the apparatus, the electrical connection has a reactance matrix, and wherein the combination of the reactance and the network impedance provides a resultant predetermined termination resistance.

7. The apparatus of claim 1, wherein the electrical connection comprises a bonding wire.

8. The apparatus of claim 1, wherein the electrical connection comprises a ribbon.

9. The apparatus of claim 1, wherein the matching circuit is operative to absorb greater than 1 W of power.

10. The apparatus of claim 1, wherein the matching circuit has a high frequency broadband width.

11. The apparatus of claim 10, wherein the matching circuit is capable of providing a return loss of less than 20 dB from DC-to-40 GHz.

12. The apparatus of claim 1, wherein the substrate comprises a microstrip.

13. A method comprising:

determining an inductance of an electrical connection used to connect a transmission line on a first planar medium to a termination circuit on a second planar medium; and selecting dimensions and a geometry for a thin film resistor operative to generate a negative inductance substantially equal in magnitude to the electrical connection inductance.

14. An apparatus for providing a termination for a high frequency circuit, the apparatus comprising:

a planar matching circuit comprising at least a resistor and a grounding means; and an electrical connection from said circuit to said planar matching circuit having a connection reactance matrix, wherein said electrical connection when combined with said planar matching circuit provides a predetermined termination resistance to said circuit, and wherein said at least one resistor is operative to generate a negative inductance.

15. The apparatus of claim 14, wherein the planar matching circuit further comprises a positive inductance to cancel with the negative inductance.

16. The apparatus of claim 14, wherein said at least one resistor comprises a plurality of resistors operative to provide a broad frequency bandwidth.

17. The apparatus of claim 14, wherein the electrical connection comprises one of a bond wire and a ribbon.

* * * * *